United States Patent [19]

Lin

[11] Patent Number: 5,072,757

[45] Date of Patent: Dec. 17, 1991

[54] FAUCET HAVING ANGULARLY ROTATABLE SPOUT

[76] Inventor: Fu-Tung Lin, c/o Hung Hsing Patent Service Center, P.O. Box 55-1670, Taipei, Taiwan

[21] Appl. No.: 689,545

[22] Filed: Apr. 23, 1991

[51] Int. Cl.[5] ..... E03C 1/02

[52] U.S. Cl. ..... 137/615; 137/801; 239/26; 285/325

[58] Field of Search ..... 137/615, 801; 239/26, 239/27; 285/281, 325

[56] References Cited

U.S. PATENT DOCUMENTS

| | | | |
|---|---|---|---|
| 1,096,021 | 5/1914 | Day | 137/615 X |
| 1,504,623 | 8/1924 | Hulla | 239/26 |
| 2,134,966 | 11/1938 | Boscow et al. | 137/616.7 X |
| 2,570,635 | 10/1951 | Beyer | 239/26 |
| 2,586,083 | 2/1952 | Poultney | 239/26 |
| 2,790,632 | 4/1957 | Mellette | 137/616.7 X |
| 4,989,278 | 2/1991 | Kostorz | 137/359 X |

*Primary Examiner*—Gerald A. Michalsky

[57] ABSTRACT

A faucet includes a spout rotatably mounted in the faucet having a nozzle formed on an outlet portion of the spout defining a nozzle axis generally perpendicular to a longitudinal axis about which longitudinal axis the spout is rotatably secured to a coupling portion formed on the faucet so that upon a rotation of the spout, a water-spraying angle can be optionally adjusted for multiple washing and drinking purposes.

3 Claims, 2 Drawing Sheets

FAUCET HAVING ANGULARLY ROTATABLE SPOUT

BACKGROUND OF THE INVENTION

A faucet with drinking attachment disclosed by N. Spatter et al in their U.S. Pat. No. 1,392,456 taught a cup device 24 fixed on a hollow tube 14 resiliently held in a stem 9 having water port 16 formed in a lower portion of the tube 14 above the plug 15 normally sealable on a main valve plug in the faucet, in which the cup device 24 can be depressed downwardly to open the plug 15 to enter water from the port 16 through the hollow tube 14 to spray upwardly for drinking purpose. However, the water streams flowing from this conventional faucet may only be discharged downwardly through the spout 8 or may be alternatively sprayed upwardly from the cup device 24. Other directions for discharging the water from this faucet were not provided. Meanwhile, the hollow tube 14 is a fine tube held within the stem 9 so that a water quantity sprayed through such a narrow tube will be so small which is not suitable for use in a condition requiring much water consumption. The cup device 24 may also be easily contaminated by a user's finger when depressing to touch the cup 24 or contaminated by dirts accumulated on the cup. It is therefore expected to disclose a faucet having a spout which is rotatably mounted in the faucet capable of adjusting a desired water-spraying angle for optional choices, and also for providing a faucet which is not easily contaminated for hygienic purpose.

SUMMARY OF THE INVENTION

The object of the present invention is to provide a faucet including a spout rotatably mounted in the faucet having a nozzle formed on an outlet portion of the spout defining a nozzle axis generally perpendicular to a longitudinal axis about which longitudinal axis the spout is rotatably secured to a coupling portion formed on the faucet so that upon a rotation of the spout, a water-spraying angle can be optionally adjusted for multiple washing and drinking purposes.

BRIEF DESCRIPTION OF THE INVENTION

DETAILED DESCRIPTION

Figure 1:
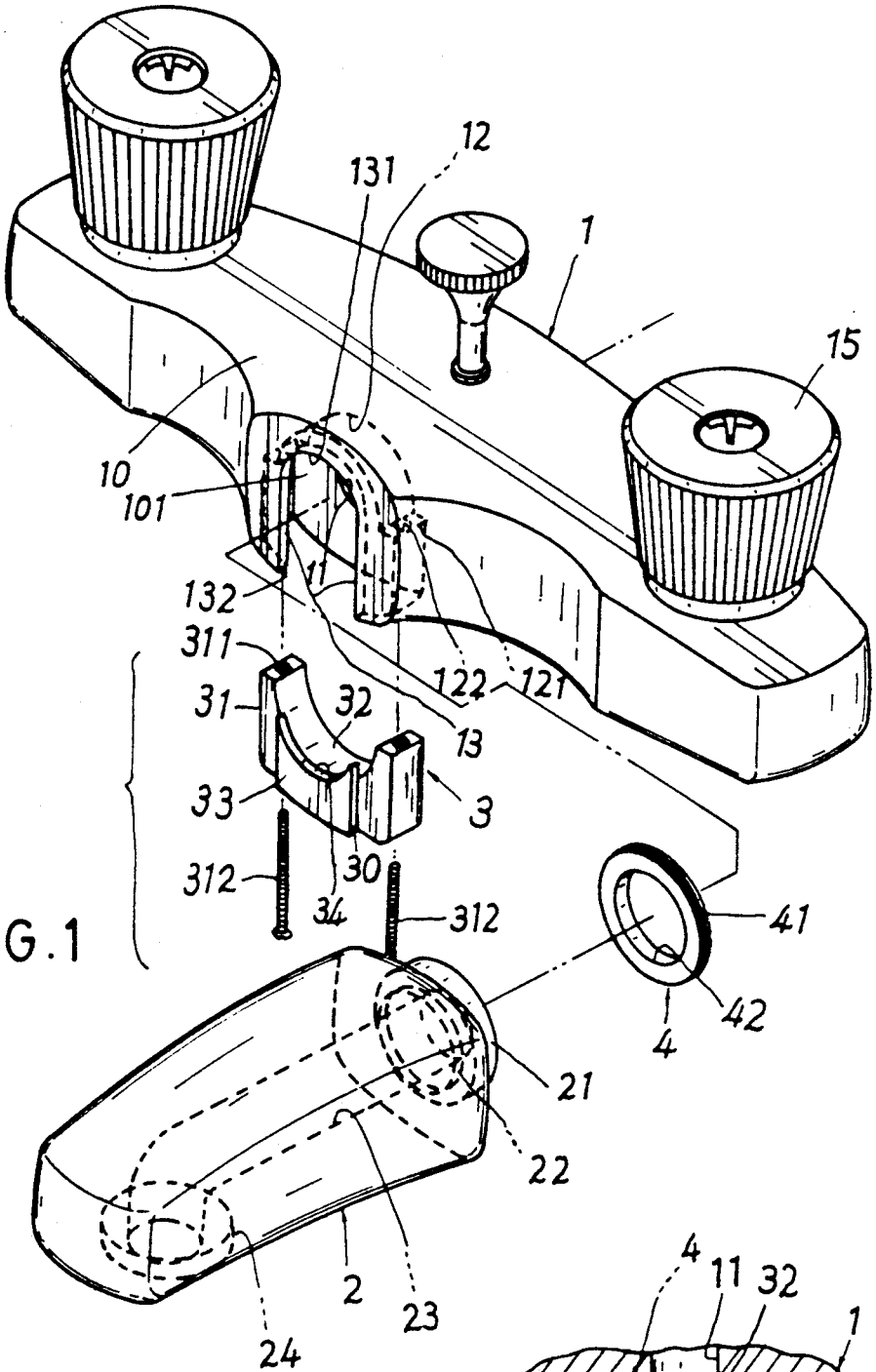
FIG. 1 is an exploded view of the present invention.
Figure 3:
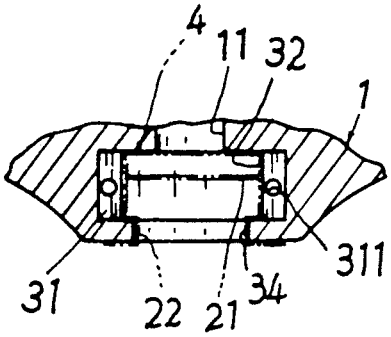
FIG. 3 is a sectional drawing of the present invention when viewed from 3—3 direction of FIG. 2.
Figure 4:
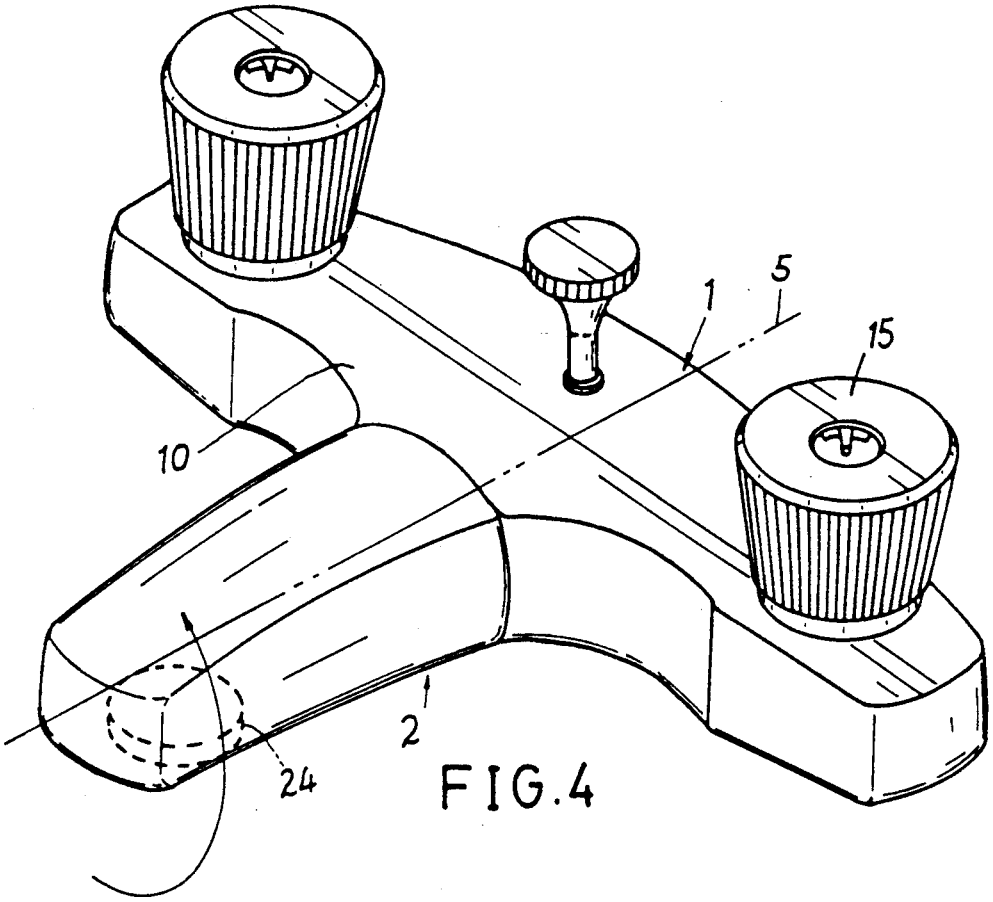
FIG. 4 is a perspective view of the present invention.
Figure 2:
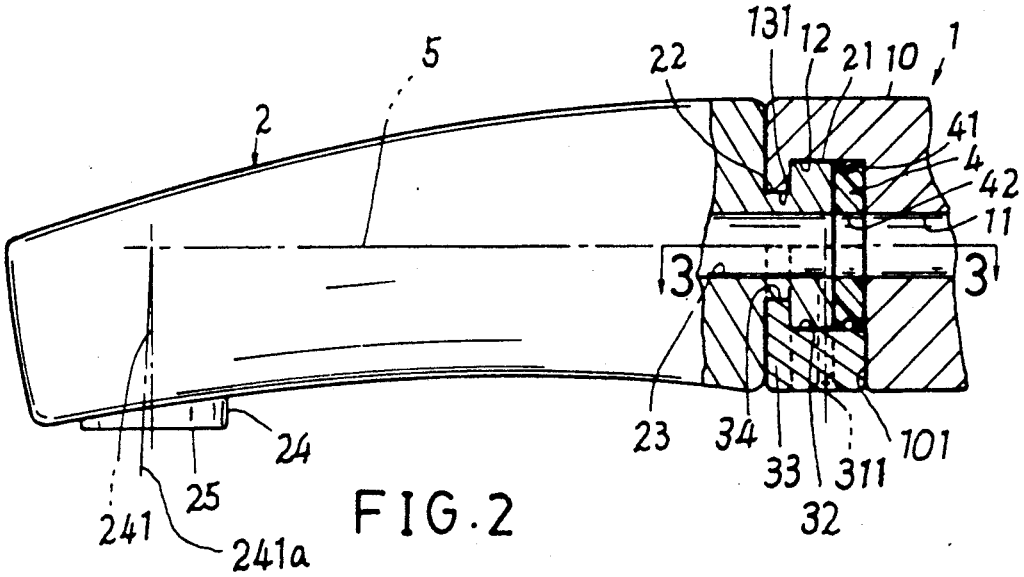
FIG. 2 is a partial sectional drawing of the present invention.

As shown in FIGS. 1–4, the present invention comprises: a faucet 1, a rotational spout 2 rotatably mounted in the faucet 1, a detachable retainer 3 secured to a bottom portion of the faucet 1, and a packing ring 4 sealed in between the spout 2 and the faucet 1.

The faucet 1 includes: a coupling portion 10 formed in a central front portion of the faucet 1, a main water passage 11 formed in a central portion of the faucet controlled by at least a valve or handle 15 formed on the faucet 1, an archway extension 13 formed on a central front portion of the faucet 1 beyond the main water passage 11 having an upper arcuate portion 131 concave upwardly in the archway extension 13, a lower opened end portion 132 formed on a lower portion of the coupling portion 10, and an upper recess 12 inwardly concave upwardly in the coupling portion 10 adjacent to the archway extension 13.

The rotational spout 2 includes: an annular coupling disk 21 generally formed as a shallow cylindrical shape annularly formed on an inner portion of the spout 2, a journal portion 22 formed between the spout 2 and the coupling disk 21 having an outside diameter smaller than a diameter of the coupling disk 21, a central water passage 23 formed in a central portion of the coupling disk 21 and the journal portion 22, and a nozzle 24 defining an outlet water port 25 formed on an outer portion of the spout 2.

The spout 2 is rotatably mounted in the coupling portion 10 of the faucet 1 about a longitudinal axis 5 which is coaxially aligned with a center line of the main water passage 11 of the faucet 1. The nozzle 24 defines a nozzle axis 241 aligned with a water spraying direction of the spout 2 which axis 241 is generally perpendicular to the longitudinal axis 5. The nozzle axis may also be slightly inclined to form an obtuse angle with the longitudinal axis 5 as shown in dotted line 241*a* of FIG. 2.

The detachable retainer 3 includes: a bottom block 30 secured to a lower portion of the coupling portion 10 of the faucet 1, a pair of side block portions 31 formed on two opposite sides of the block 30 respectively engageable with two side extensions 121 which are recessed in two opposite side portions of the coupling portion 10 disposed on two opposite sides of the upper recess 12, a lower recess 32 concave downwardly in an inner portion of the bottom block 30 combinable with the upper recess 12 of the coupling portion 10 of the faucet 1 to define a disk hole (32, 12) of circular shaper for rotatably engaging the annular coupling disk 21 of the spout 2, a lower arcuate extension 33 formed on an outer portion of the bottom block 30 defining a lower arcuate portion 34 concave downwardly in the lower arcuate extension 33 combinable with the upper arcuate portion 131 of the archway extension 13 to define a journal hole (34, 131) of circular shape for rotatably engaging the journal portion 22 of the spout 2.

Each side block portion 31 is drilled a screw hole 311 therethrough so that each screw 312 is inserted into the screw hole 311 for securing each side block portion 31 with each side extension 121 which is also drilled an upper screw hole 122 as shown in FIG. 1 for the insertion of the screw 312.

The packing ring 4 made of elastic materials such as Teflon includes: an annular groove 41 annularly recessed in an outside perimeter of the ring 4, and a central hole 42 communicated with the main water passage 11 in the faucet 1 and the central water passage 23 in the spout 2. The packing ring 4 is sealably engaged in the upper recess 12 of the coupling portion 10, and the lower recess 32 of the detachable retainer 3 and packed between the coupling disk 21 of the spout 2 and a vertical flat portion 101 formed in an inner portion of the coupling portion 10 perpendicularly intersecting the main water pasaage 11.

The longitudinal axis 5 is commonly aligned with a center line of the water passage 23 in spout 2, a center line of the coupling disk 21, and a center line of the main water passage 11 in the coupling portion 10 of faucet 1 so that the spout 2 can be rotatably mounted to the faucet 1 about the longitudinal axis 5.

For assembling the present invention, the packing ring 4 is inserted inwardly into the coupling portion to seat on the flat portion 101, and the coupling disk 21 of the spout 2 is inserted into the coupling portion 10 of the faucet 1 retained by the packing ring 4, and the retainer 3 is secured to a lower portion of the coupling portion 10 so that the coupling disk 21 can be rotatably engageable with a disk hole defined by the upper recess 12 and the lower recess 32 and the journal portion 22 of the spout 2 can be rotatably retained in a journal hole defined by the upper arcuate portion 131 and the lower arcuate portion 34 for a smooth rotation of the spout 2 on the faucet 1. The packing ring 4 is formed with the annular groove 41 for firmly sealing the rotational parts of this invention. For ensuring an absolute sealing purpose and preventing any water leakage from this invention, the archway extension 13, the retainer 4 and the coupling portion 10 of the faucet 1 may be further coated with a thin layer of packing material on an inside surface of each rotational part in construction of the present invention.

The shapes, structures, and materials of the elements of the present invention are not limited.

Upon an opening of the valve 15 to flow water through the passage 11, 23, a water stream can be sprayed outwardly through the port 25 of the nozzle 24 formed on an end portion of the spout 2, and upon the rotation of the spout 2 on the faucet 1, any water spraying angle can be optionally adjusted for any desired washing or drinking purpose.

For instance, the nozzle 24 with spout 2 can be rotated upwardly for forming a fountain for drinking use or rinsing a user's mouth, and the spout 2 can be rotated at an inclined angle to spray water sidewardly for washing a user's hair, for instance.

The retainer 3 can be easily dismantled for maintenance job such as for replacing a used or worn packing ring 4. The retainer 3 is fixed on a bottom portion of the faucet 1 without influencing an esthetic decorative feature of the faucet.

Therefore, this invention is superior to any conventional faucet.

What is claimed is:

1. A faucet comprising:

a coupling portion having a main water passage formed therein, an archway extension formed on a central front portion of the coupling portion beyond the main water passage having an upper arcuate portion concave upwardly in the archway extension, a lower opened end portion formed in a lower portion of the archway extension, and an upper recess inwardly concave upwardly in the coupling portion adjacent to the archway extension;

a spout having a coupling disk formed as a shallow cylindrical shape annularly formed on an inner end portion of the spout rotatably secured in said coupling portion of said faucet, a journal portion formed between the spout and the coupling disk, a nozzle with an outlet water port formed on an outer end portion of the spout, and a central water passage formed in said coupling disk communicated with said main water passage and said outlet water port; and a detachable retainer detachably secured on the lower opened end portion of said coupling portion of said faucet rotatably engaging said coupling disk in cooperation with said coupling portion of said faucet, said detachable retainer including: a bottom block secured to a lower portion of the coupling portion of the faucet, a pair of side block portions formed on two opposite sides of the block respectively engageable with two side extensions which are recessed in two opposite side portions of the coupling portion disposed on two opposite sides of the upper recess, a lower recess concave downwardly in an inner portion of the bottom block combinable with the upper recess of the coupling portion of the faucet to define a circular disk hole for rotatably engaging the coupling disk of the spout, a lower arcuate extension formed on an outer portion of the bottom block defining a lower arcuate portion concave downwardly in the lower arcuate disk combinable with the upper arcuate portion of the archway extension to define a circular journal hole for rotatably engaging the journal portion of the spout.

2. A faucet according to claim 1, wherein each said side block portion is drilled with a screw hole therethrough so that each screw is inserted into the screw hole of said side block portion for securing each said side block portion with each said side extension which is also drilled an upper screw hole for the insertion of the screw.

3. A faucet according to claim 1, wherein said faucet includes a packing ring made of elastic materials having an annular groove annularly recessed in an outside perimeter of the packing ring, and a central hole communicated with the main water passage in the faucet and the central water passage in the spout, said packing ring sealably engageable with the upper recess of the coupling portion, and the lower recess of the detachable retainer and packed between the coupling disk of the spout and a vertical flat portion formed in an inner portion of the coupling portion perpendicularly intersecting the main water passage of the faucet.

* * * * *